US008963656B2

(12) United States Patent
Ali

(10) Patent No.: US 8,963,656 B2
(45) Date of Patent: Feb. 24, 2015

(54) APPARATUS, SYSTEM, AND METHOD FOR A COMPACT SYMMETRICAL TRANSITION STRUCTURE FOR RADIO FREQUENCY APPLICATIONS

(75) Inventor: Mohammed Ershad Ali, Sunnyvale, CA (US)

(73) Assignee: Silicon Image, Inc., Sunnyvale, CA (US)

( * ) Notice: Subject to any disclaimer, the term of this patent is extended or adjusted under 35 U.S.C. 154(b) by 792 days.

(21) Appl. No.: 13/113,318

(22) Filed: May 23, 2011

(65) Prior Publication Data

US 2011/0285474 A1 Nov. 24, 2011

Related U.S. Application Data

(60) Provisional application No. 61/347,776, filed on May 24, 2010.

(51) Int. Cl.
*H01P 5/10* (2006.01)

(52) U.S. Cl.
CPC ..... *H01P 5/10* (2013.01)
USPC ..... 333/238; 333/26

(58) Field of Classification Search
CPC ..... H01P 5/10
USPC ..... 333/33, 238, 246, 25, 26
See application file for complete search history.

(56) References Cited

U.S. PATENT DOCUMENTS

| | | | |
|---|---|---|---|
| 6,603,383 | B2 | 8/2003 | Gevorgian et al. |
| 2008/0191957 | A1 * | 8/2008 | Chang ..... 343/845 |

FOREIGN PATENT DOCUMENTS

| | | | |
|---|---|---|---|
| CN | 1934750 | A | 3/2007 |
| CN | 101553956 | A | 10/2009 |
| EP | 0709913 | A2 | 5/1996 |
| EP | 1758200 | A2 | 2/2007 |
| GB | 2089135 | A | 6/1982 |
| JP | S49-089185 | | 2/1976 |
| JP | 2002-374118 | A | 12/2002 |
| JP | 2005-020677 | A | 1/2005 |
| JP | 2007-082198 | A | 3/2007 |
| JP | 2010-050627 | A | 3/2010 |
| WO | 0180349 | A1 | 10/2001 |

OTHER PUBLICATIONS

European Patent Office Registered Letter—Comments on Written Opinion mailed Jan. 15, 2013 for European Patent Application No. 11729096.6, 2 pages.

(Continued)

*Primary Examiner* — Stephen E Jones

(74) *Attorney, Agent, or Firm* — Fenwick & West LLP

(57) ABSTRACT

Described herein are an apparatus, system, and method having a compact symmetrical transition structure for RF applications. The apparatus comprises: first and second ground planes each of which having respective truncated edges, the first and second ground planes being parallel to one another and separated by a multi-layer substrate; a strip line positioned between the first and second ground planes; and a symmetrical transition structure, coupled to the strip line and the first and second ground planes near their respective truncated edges, and further coupled to a broadside coupled line (BCL).

28 Claims, 11 Drawing Sheets

(56) References Cited

OTHER PUBLICATIONS

International Preliminary Report on Patentability and Written Opinion of the International Searching Authority mailed on Dec. 6, 2012 for corresponding PCT Patent Application No. PCT/US2011/037748, 7 pages.

PCT International Search Report for corresponding PCT Patent Application No. PCT/US2011/037748, Sep. 2, 2011, 4 pgs.

PCT Written Opinion of the International Searching Authority for corresponding PCT Patent Application No. PCT/US2011/037748, Sep. 2, 2011, 6 pgs.

Chinese Office Action, Chinese Application No. 201180025616.9, Apr. 15, 2014, 15 pages.

* cited by examiner

APPARATUS, SYSTEM, AND METHOD FOR A COMPACT SYMMETRICAL TRANSITION STRUCTURE FOR RADIO FREQUENCY APPLICATIONS

CLAIM OF PRIORITY

The present patent application claims priority to and incorporates by reference the corresponding provisional Patent Application Ser. No. 61/347,776, titled, "SUBSTRATE INTEGRATED END-FIRE RF ANTENNA COMPATIBLE WITH RFIC PACKAGING" filed on May 24, 2010.

FIELD OF THE INVENTION

Embodiments of the invention relate generally to the field of radio frequency (RF) applications. More particularly, embodiments of the invention relate to an apparatus, system, and method for a compact symmetrical transition structure for RF applications.

BACKGROUND

For a multilayer substrate with one or more ground planes and single-ended signal distribution, as is typical at millimeter wave frequencies, patch antennas are used for easy integration with radio frequency integrated circuits (RFICs). While patch antennas are efficient in terms of radiation and only require a single-ended feed, they radiate mainly in the plane normal to the substrate. This radiation direction makes it difficult for mounting the substrate on a chassis of a typical consumer electronic product where the radiation comes out only in a direction parallel to the substrate. To overcome this problem, end-fire antennas are used which can radiate predominantly towards the edge of the antenna. The most common type of end-fire antenna with end-fire radiation is a planar dipole antenna.

However, the integration of a conventional planar dipole antenna in a multi-layer substrate is challenging because the need for balanced feed to the conventional planar dipole antenna and removal of ground planes near the conventional planar dipole antenna make the total size of the antenna quite large. Moreover, the large sized conventional planar dipole antennas, when packed in array topologies with driving RFICs in the same package on a common substrate, are challenging because of the large size to integrate within consumer electronic devices which are becoming smaller in size.

SUMMARY OF THE INVENTION

Described herein are embodiments of apparatus, system, and method for a compact symmetrical transition structure for Radio Frequency (RF) applications that allow integration of a non-planar antenna with a single-ended RF signal distributed on a signal plane that is positioned between two parallel ground planes resulting in a compact design for high volume manufacturing.

Described herein is an apparatus comprising: first and second ground planes with their respective truncated edges, the first and second ground planes being parallel to one another and separated by a multi-layer substrate; a strip line between the first and second ground planes; and a symmetrical transition structure, coupled to the strip line and the first and second ground planes near their respective truncated edges, and further coupled to a broadside coupled line (BCL), according to one embodiment of the invention. In one embodiment the symmetrical transition structure comprises: a via to couple the strip line to a first metal line of the BCL; and a metal line symmetrical around the via and coupled to the first and second ground planes near their respective truncated edges and further coupled to a second metal line of the BCL.

Described herein is a system comprising a radio frequency integrated circuit (RFIC); a plurality of strip lines coupled to the RFIC, the plurality of strip lines positioned between first and second ground planes which are parallel to one another, each of the first and second ground planes having respective truncated edges; and a plurality of symmetrical transition structures, each of which is coupled to a corresponding strip line from the plurality of strip lines, and to the first and second ground planes near their respective truncated edges, and further coupled to a plurality of broadside coupled lines (BCLs).

Described herein is a method of forming an RF application having a compact symmetrical transition structure, the method comprises forming first and second ground planes, each having their respective truncated edges, the first and second ground planes being parallel to one another and separated by a multi-layer substrate; forming a strip line between the first and second ground planes; and coupling a symmetrical transition structure to the strip line and the first and second ground planes near their respective truncated edges, and further coupling the symmetrical transition structure to a broadside coupled line (BCL).

BRIEF DESCRIPTION OF THE DRAWINGS

Embodiments of the invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Described herein are embodiments of apparatus, system, and method for a compact symmetrical transition structure for Radio Frequency (RF) applications that allow integration of a non-planar antenna with a single-ended RF signal distributed on a signal plane that resides between two ground planes resulting in a compact design for high volume manufacturing.

Figure 1:
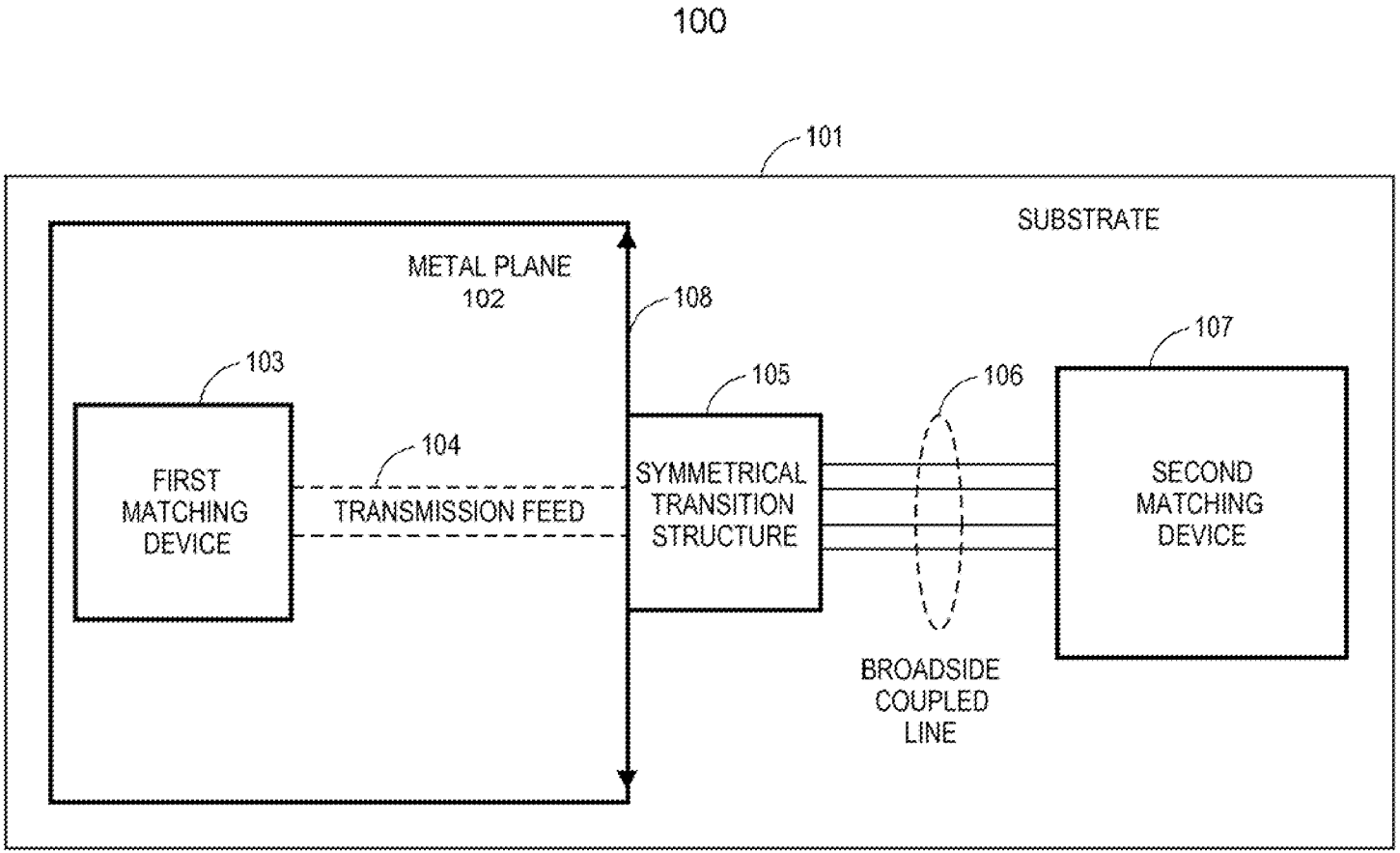
FIG. 1 illustrates a high level radio frequency (RF) device with integrated matching devices having a compact symmetrical transitional structure, according to one embodiment of the invention

FIG. 1 illustrates a high level radio frequency (RF) device 100 with integrated matching devices having a compact symmetrical transitional structure, according to one embodiment of the invention. In one embodiment, the RF device 100 comprises a first matching device 103 coupled to a second matching device 107 via a transmission feed 104, symmetrical transition structure 105, and a pair of broadside coupled lines (BCLs) 106. In one embodiment, the transmission feed 104 is positioned between two parallel ground planes (only top ground plane 102 is shown) having respective truncated edges 108.

In one embodiment, the transmission feed 104 is a strip line which is configured to carry a millimeter wave signal to and from the first matching device 103. In one embodiment, the first matching device 103 comprises a radio frequency integrated circuit (RFIC). In another embodiment, the first matching device 103 is a probe pad to probe the signal received by the transmission feed 104. In one embodiment, the impedance of the first matching device 103 is matched to the impedance of the transmission feed 104.

In one embodiment, the transmission feed 104 is coupled to the first matching device 103 on one end of the transmission feed 104, and coupled to the symmetrical transition structure 105 on the other end of the transmission feed 104. In one embodiment, the technical effects of the symmetrical transition structure 105 are that it provides a function of a balun, reduces (and potentially minimizes) the effect of discontinuities of the truncated ground planes by providing discontinuity matching when wave signals transmission to and from the first matching device 103 to the second matching device 107, and reduces the size of the RF device 101 by providing a small transitional structure that solves the size problems mentioned above with reference to conventional planar dipole antennas integrated in a multi-layer substrate. In one embodiment, the symmetrical transition structure 105 also reduces, and potentially minimizes, the excitations of undesirable parasitic and higher-order modes by providing symmetrical avenues for flow of current to/from the ground planes and the BCLs 106.

In one embodiment, the second matching device 107 includes a non-planar dipole antenna. In one embodiment, the impedance of the second matching device 107 is matched to the impedance of the BCL 106 to reduce, and potentially minimize, signal reflections. In one embodiment, the non-planar dipole antenna is an end-fire antenna. In one embodiment, the non-planar dipole antenna comprises two dipole arms, each arm coupled to a corresponding BCL 106. In one embodiment, the two dipole arms are orthogonal to their corresponding BCL 106. In one embodiment, the second matching device 107 includes a non-planar folded dipole antenna. In one embodiment, the second matching device 107 includes a non-planar bow-tie antenna.

In one embodiment, a plurality of transmission feeds are coupled to the first matching device (RFIC) 103, wherein the plurality of transmission feeds are positioned between first and second ground planes which are parallel to one another, each of the first and second ground planes having respective truncated edges 108. In one embodiment, the apparatus further comprises a plurality of symmetrical transition structures, each of which is coupled to a corresponding transmission feed from the plurality of transmission feeds, and to the first and second ground planes near their respective truncated edges, and further coupled to a plurality of broadside coupled lines (BCLs).

In one embodiment, each of the plurality of symmetrical transition structures comprises: a metal line symmetrical around a via, filled or plated with metal, and coupled to the first and second ground planes near their respective truncated edges 108, and further coupled to the second metal line of the BCL, wherein the via couples the corresponding transmission feed, from the plurality of transmission feeds, to the first metal line of the BCL 106. A system comprising the plurality of transmission feeds 104, symmetrical transition structures 105, and BCLs 106 is discussed later with reference to FIGS. 5-6.

Figure 2A:
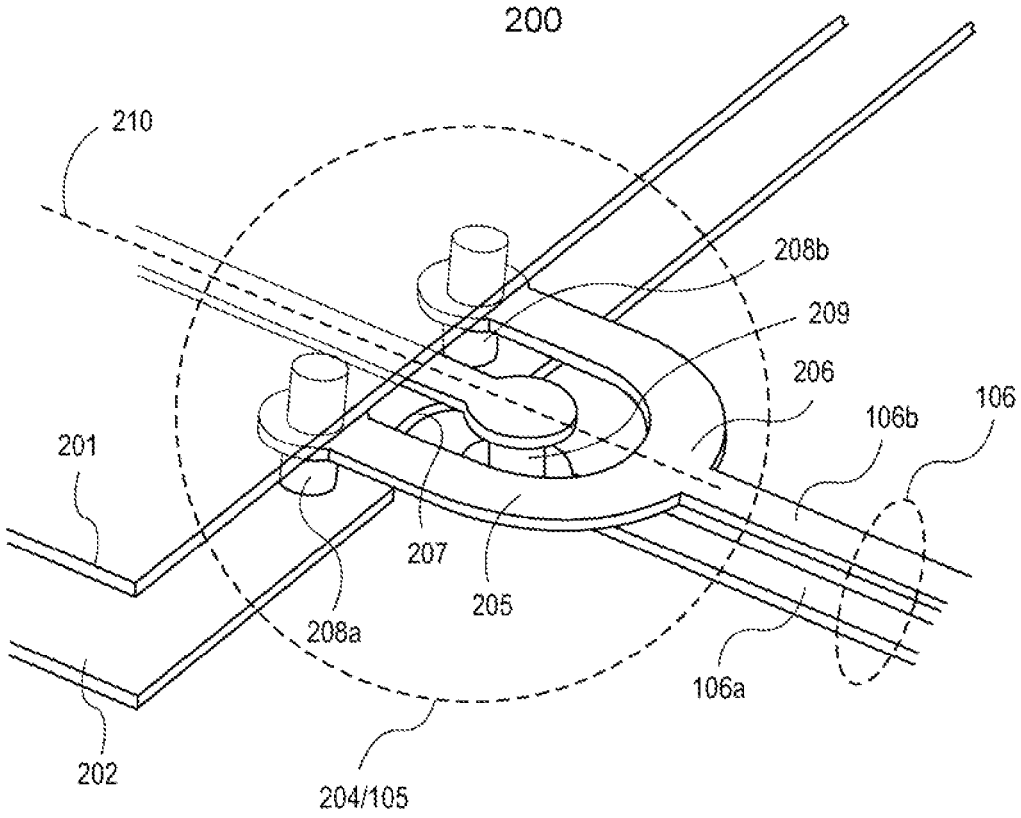
FIG. 2A illustrates a top view of a symmetrical transitional structure coupling a strip line to a Broad Coupled Line (BCL), according to one embodiment of the invention

FIG. 2A illustrates a top view 200 of a symmetrical transitional structure 204/105 coupling a strip line 104 to a pair of BCLs 106, according to one embodiment of the invention. In one embodiment, the strip line 104 resides between the two ground planes 201 and 202, wherein the two ground planes are separated by a substrate. In one embodiment, the substrate is a multi-layer substrate i.e., the substrate extends above and below the ground planes.

In one embodiment, the symmetrical transitional structure 204/105 comprises a metal line 205 which is configured in a symmetrical line around via 209 which is filled or plated with metal. In one embodiment, when the via 209 is plated with metal, any remaining hole/void associated with the via 209 is filled with substrate material (e.g., resin). In one embodiment, the axis of symmetry 210 runs along the length of the strip line 104. In one embodiment, the via 209, which is filled or plated with metal, electrically couples the strip line 104 to a first metal line **106*a* of the BCL 106. In such an embodiment, the first metal line 106*a* is at a plane different from the plane of the strip line 104. In one embodiment, a second metal line 106*b* of the BCL 106 couples to the symmetrical transition structure 204/105 near the middle 206 of the symmetry of the metal line 205. The term "near the middle" herein refers to being within 10% of the axis of symmetry 210**.

In one embodiment, the ends of the metal line 205 of the symmetrical transitional structure 204/105 are electrically coupled to the two ground planes 201 and 202 by use of vias **208*a* and 208*b* (which are filled or plated with metal) near the truncated edges of the ground planes 201 and 202. In one embodiment, when the vias 208*a* and 208*b* are plated with metal, any remaining hole/void associated with the vias 208*a* and 208*b* is filled with substrate material (e.g., resin). The term "near the truncated edges" refers to the vias 208*a* and 208*b* being closer in distance to the truncated edges than they are from the first matching device 103. In one embodiment, the vias 208*a* and 208*b* (and 223*a/b* of FIG. 2B) are as close to the truncated edges 108 of the ground planes 201 and 202** as the manufacturing/process design rules allow.

Referring back to FIG. 2A, in one embodiment a notch 207 is made in the ground plane 202 to bring the via 209 closer to the truncated edge of the ground plane 202. In such an embodiment, the overall size of the symmetrical transition structure 204/105 reduces to allow for a more compact symmetrical transition structure 204/105.

In one embodiment, the vias **208*a* and 208*b* (which are filled or plated with metal) electrically short the ground planes 201 and 202 to one another near the truncated edges of the ground planes 201 and 202. In one embodiment, shorting the ground planes, by the metals in the vias 208***a* and 208*b* of the symmetrical transitional structure 204/105, near their respective truncated edges, results in redirecting current distribution near the truncated edges towards the metal line 205, thus providing a current return path near either sides of the strip line 104. In such an embodiment, the current on the ground plane near either sides of the strip line 104 is 180 degrees out of phase from the current on the strip line 104. Such out of phase currents cause the symmetrical transitional structure 204/105 to operate as a balun.

In one embodiment, the truncated edges of the ground planes 201 and 202 are continuously smooth. In one embodiment, the truncated edges of the ground planes 201 and 202 are continuously serrated. In another embodiment, the truncated edges of the ground planes 201 and 202 have notches in them e.g., the notch 207. In one embodiment, the ground planes 201 and 202 are solid ground planes. In another embodiment, the ground planes 201 and 202 are meshed ground planes. In one embodiment, the ground planes 201 and 202 are a combination of mesh and solid ground planes.

In one embodiment, the metal line 205 of the symmetrical transitional structure 204/105 is at the same plane as the strip line 104. In one embodiment, the metal line 205 is a fork shaped metal line with its two prongs coupled to vias 208*a* and 208*b* respectively. In such an embodiment, the common point where the two prongs of the metal line 205 originate is referred to the "middle" 206 of the metal line 205 and is the point which couples to the second metal line 106*b* of the BCL 106.

In one embodiment, the metal line 205 is a curved metal line resembling a horse shoe around the via 209. In one embodiment, the two ends of the metal horse shoe are coupled to the vias 208*a* and 208*b*. In other embodiments, the metal line 205 is a semi rectangular/square metal line, wherein the two ends of the semi rectangular/square metal line are coupled to the vias 208*a* and 208*b*. The technical effect of a curved metal line for the metal line 205 is reduced discontinuities compared to semi rectangular/square shaped (not shown) metal line 205. In one embodiment, the curved section of the metal line 205 is replaced with a mitered section of the metal line 205. The size and shape of the curved section of the metal line 205 can be adjusted to adjust the impedance of the transitional structure 204/105 for matching the impedance of the transitional structure 204/105 with the impedance of the BCL 106.

In one embodiment, one or more metal stubs (not shown) are added to the first and second metal lines 106*a* and 106*b* to match impedance of the first and second metal lines 106*a* and 106*b* with that of the second matching device 107. In one embodiment, the stubs are placed orthogonal to the first and second metal lines 106*a* and 106*b* along the direction of the ground planes 201 and 202. In one embodiment, one or more stubs (not shown) are added on either side of the strip line 104 to match the impedance of the strip line 104 with that of the first matching device 103. In one embodiment, the stubs are placed orthogonal to the strip line 104 along the direction of the ground planes 201 and 202.

Figure 2B:
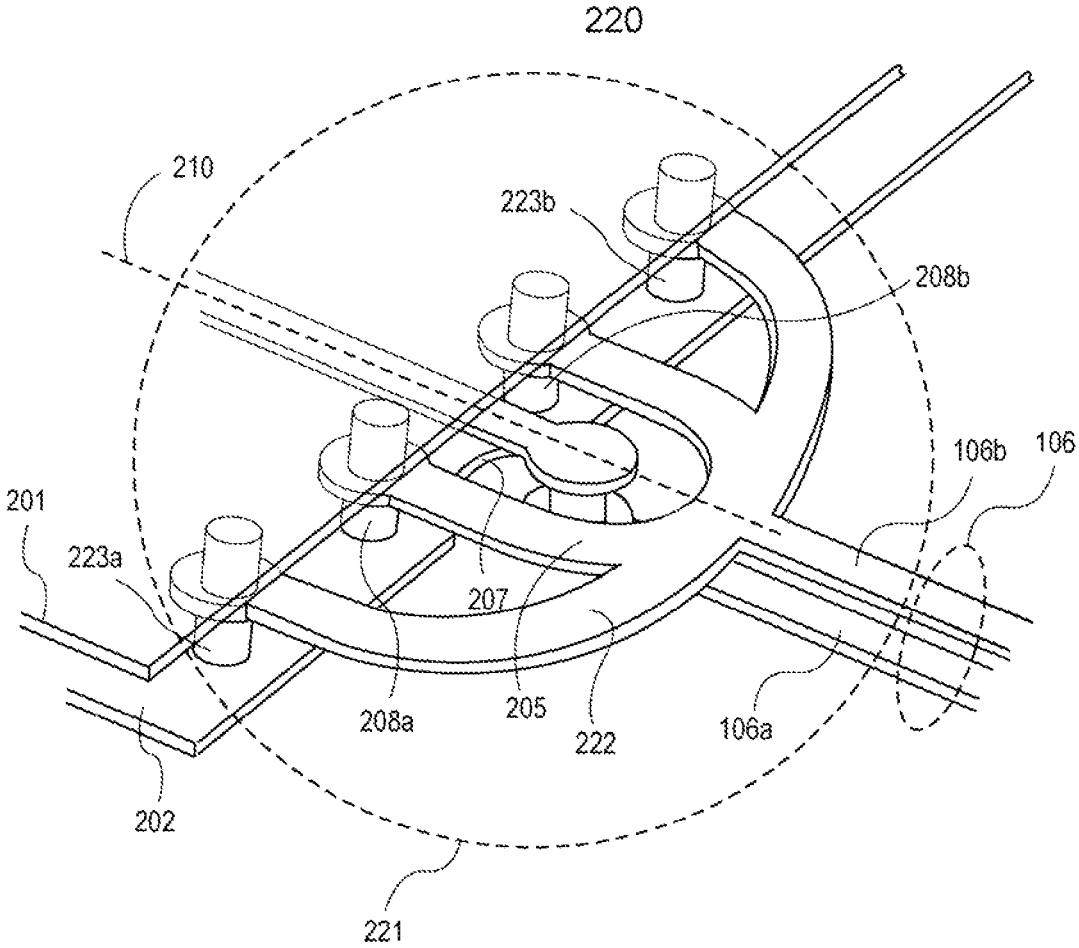
FIG. 2B illustrates a top view of a symmetrical transitional structure coupling the strip line to the BCL, according to another embodiment of the invention.

FIG. 2B illustrates a top view 220 of a symmetrical transitional structure coupling the strip line 104 to the BCL 106, according to another embodiment of the invention. FIG. 2B is discussed with reference to FIG. 1 and FIG. 2A. In one embodiment, another metal line 222 is added within the symmetrical transitional structure 221. In such an embodiment, the other metal line 222 is fork-like and is positioned around the metal line 205 and is also symmetrical around the via 209. In one embodiment, the metal line 222 of the symmetrical transitional structure 204/105 is at the same plane as the strip line 104 and the metal line 205.

In one embodiment, the symmetrical shape of the outer metal line 222 is the same shape as the symmetrical shape of the inner metal line 205. In one embodiment, the metal line 222 is a curved metal line like the metal line 205 resembling a horseshoe around the via 209. In one embodiment, the two ends of the metal horseshoe are coupled to the vias 223*a* and 223*b*. In other embodiments, the metal line 222 is a semi rectangular/square metal line, wherein the two ends of the semi rectangular/square metal line are coupled to the vias 223*a* and 223*b*. The technical effect of the additional metal line 222 (additional to the metal line 205) is to provide an additional avenue for redirecting current distribution near the truncated edges towards the metal lines 205 and 222, thus providing a current return path near either sides of the strip line 104. In one embodiment, the metal 222 is a semi rectangular/square shaped (not shown) metal line.

Figure 3A:
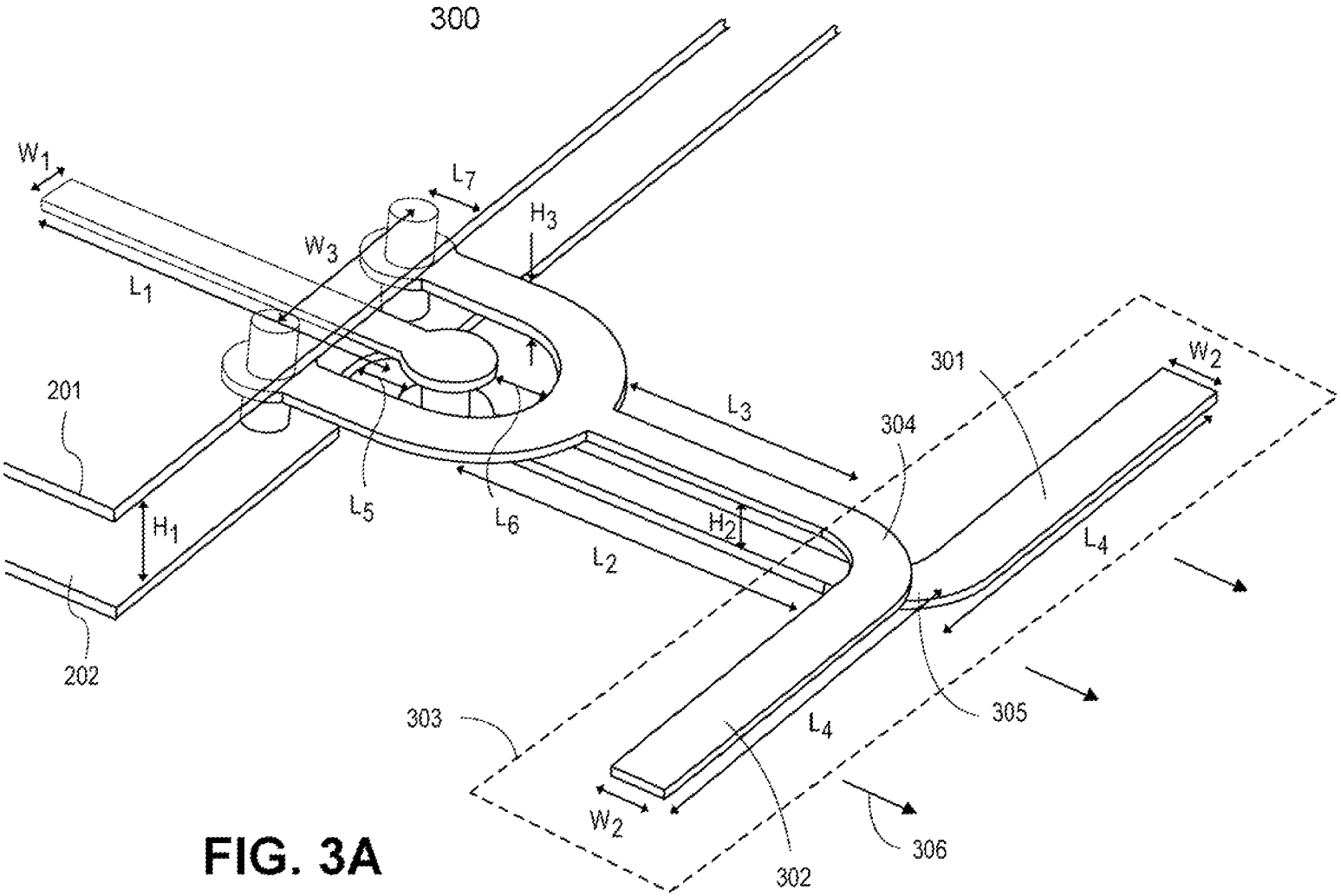
FIG. 3A illustrates a top view of the symmetrical transitional structure coupling the strip line with a non-planar antenna, according to one embodiment of the invention.

FIG. 3A illustrates a top view 300 of the symmetrical transitional structure coupling the strip line 104 to non-planar antenna, according to one embodiment of the invention. In one embodiment, the two metal lines 106*a* and 106*b* of the BCL 106 are electrically coupled to a non-planar dipole antenna 303. In one embodiment, the two metal lines 106*a* and 106*b* of the BCL 106 are electrically coupled to a non-planar folded dipole antenna (not shown). The term "non-planar" herein refers to the elements of the second matching device 107 (e.g., arms of a dipole antenna) which do not reside on the same plane as each other. In one embodiment, the non-planar antenna is non-planar end-fire antenna.

In one embodiment, the non-planar dipole antenna comprises first and second dipole arms 301 and 302 which are coupled to the two metal lines 106*a* and 106*b* of the BCL 106, respectively. In one embodiment, the first dipole arm 301 is positioned orthogonally to the metal line 106*a*. In one embodiment, the second dipole arm 302 is positioned orthogonally to the metal line 106*b*. In one embodiment, the BCL 106 and the first and second dipole arms 301 and 302 are embedded in substrate with no ground planes above or below them.

In one embodiment, the region 305 at which the first dipole arm 301 is positioned orthogonally to the metal line 106*a* is a curved region. In one embodiment, the region 304 at which the first dipole arm 302 is positioned orthogonally to the metal line 106*b* is a curved region. In one embodiment, the curved regions 304 and 305 reduce the effects of discontinuities when the signal waves transition to/from the dipole arms 301 and 302 from/to metal lines 106*a* and 106*b* respectively. In one embodiment, the regions 304 and 305 are mitered (not shown). In another embodiment, the region 304 and 305 are L-shaped.

In one embodiment, the electric current on the dipole arms 301 and 302 is unidirectional at a frequency of operation. In one embodiment, the radiation pattern of the dipole antenna, with arms 301 and 302, is in the direction 306 which is perpendicular to the dipole arms 301 and 302. In one embodiment, one or more directors (not shown) are added to direct the radiation pattern 306.

In one embodiment, the substrate is made of PPE (polyphenyl ether) based PCB (printed circuit board) laminate MEGTRON6 with a dielectric constant of 3.5. In one embodiment, the metal lines (104, 106, 205, 222) and ground planes (201 and 202) are made of Copper. In one embodiment, the nominal dimensions in microns of various features of FIG. 3A are: L1=1200, L2=625, L3=425, L4=800, L5=L6=L7=100, H1=178, H2=80, H3=18, W1=75, W2=100 and W3=400. The end-fire antenna described herein has a return loss of below −10 dB from 50 Ghz to beyond 80 GHz, has a bandwidth of more than 30 GHz, has a radiation efficiency of more than 80% over the frequency range of 40-80 GHz, and a FWHM (full width at half maximum) beam-width of greater than 150 degrees in the elevation plane. In one embodiment, the end-fire antenna is used for linear phased arrays.

Figure 3B:
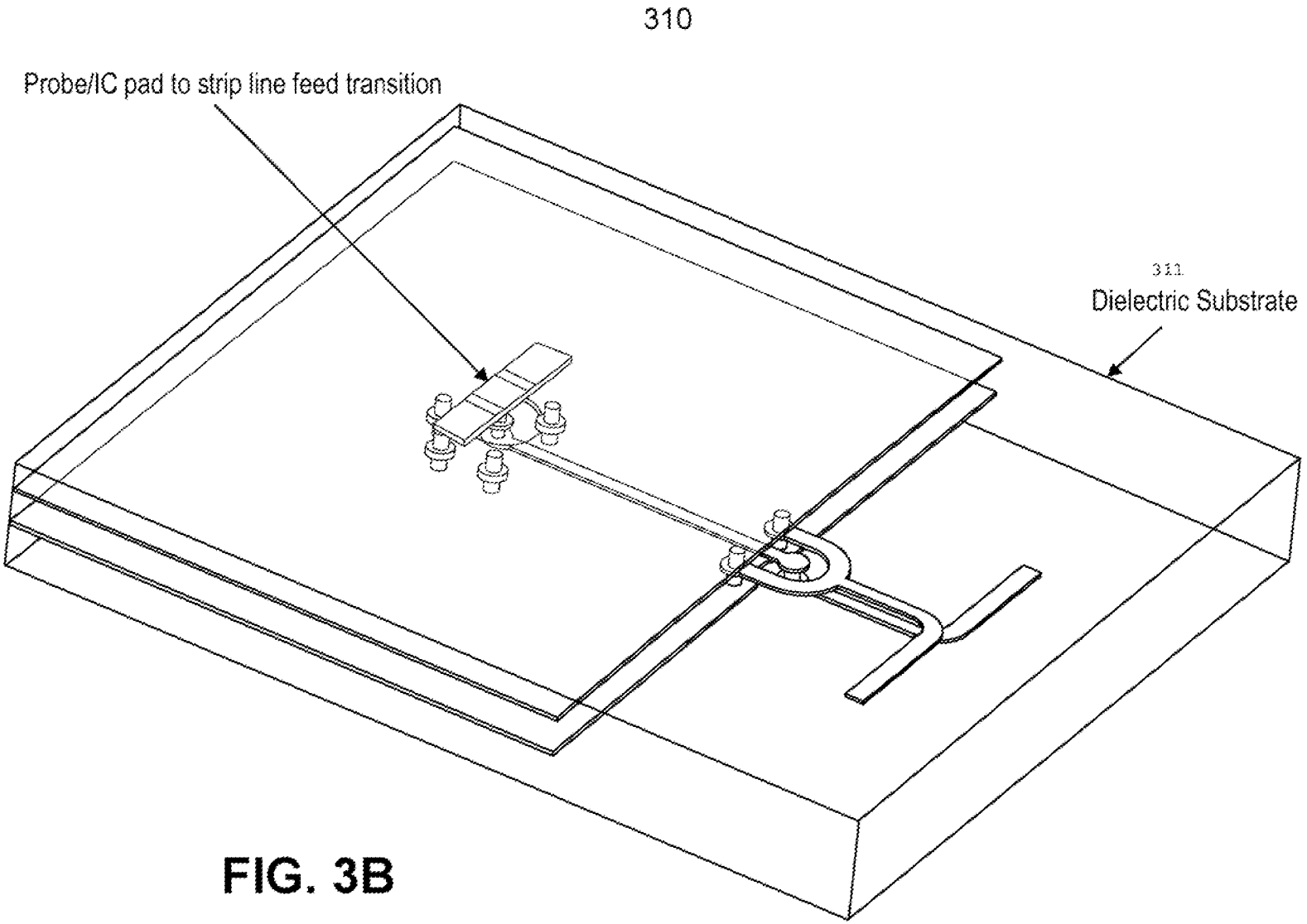
FIG. 3B illustrates a top view of a substrate integrated non-planar dipole end-fire antenna of FIG. 3A coupled to the symmetrical transitional structure and compatible with a radio frequency integrated circuit (RFIC), according to one embodiment of the invention.
Figure 3C:
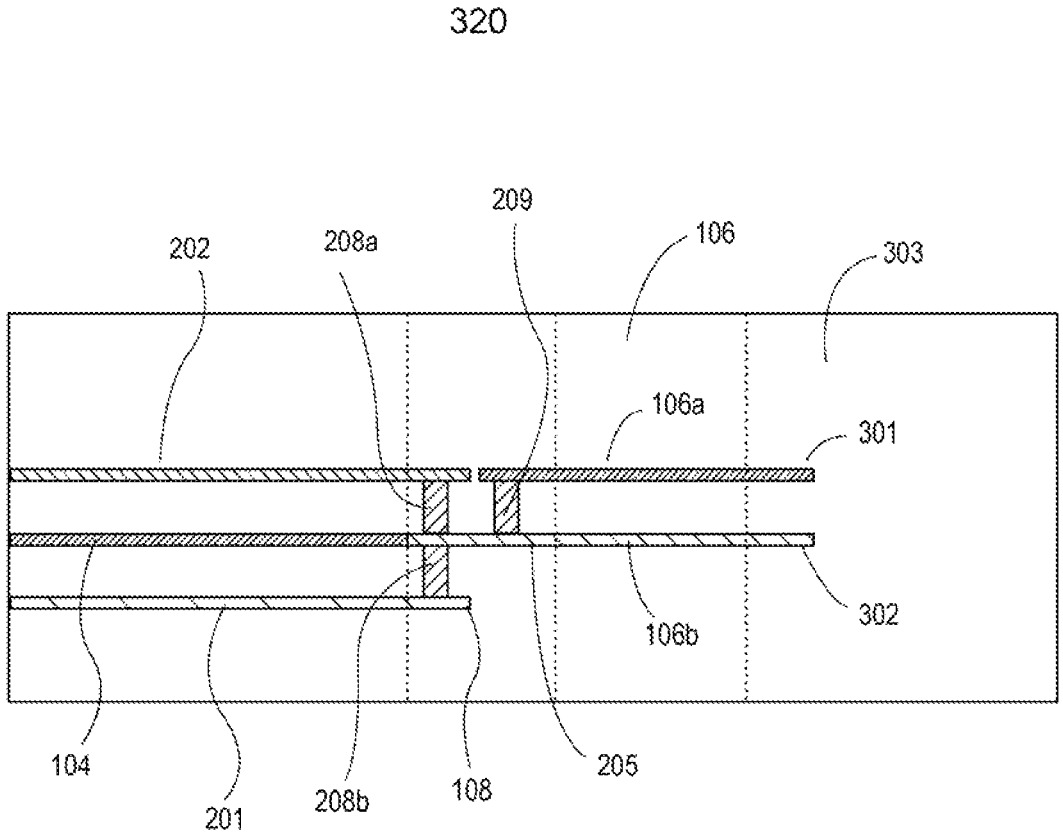
FIG. 3C illustrates a side view of FIG. 3B, according to one embodiment of the invention.

FIG. 3B illustrates a top view 310 of a substrate integrated non-planar dipole end-fire radio frequency (RF) antenna of FIG. 3A coupled to the symmetrical transitional structure and compatible with an RF integrated circuit (RFIC), according to one embodiment of the invention. In one embodiment, the first matching device 103 is a probe pad to probe the signal on the strip line 104. In one embodiment, the first matching device 103 is an RFIC. In one embodiment, the apparatus (ground planes, transitional structure, BCL) are positioned in a dielectric substrate 311 which forms the multi-layer substrate. FIG. 3C illustrates a side view 320 of FIG. 3B, according to one embodiment of the invention.

Figure 3D:
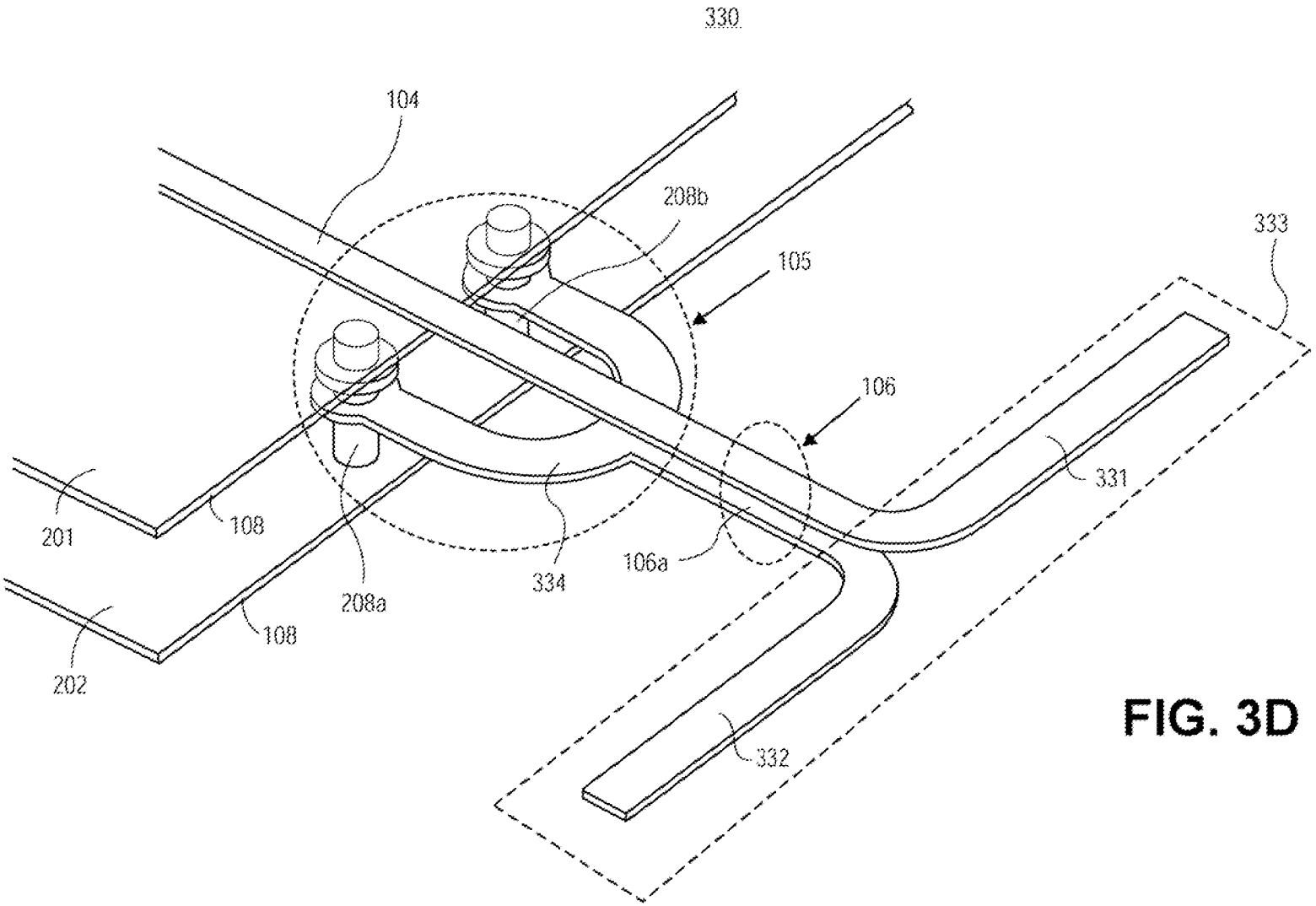
FIG. 3D illustrates a top view of the symmetrical transitional structure coupling the strip line to a non-planar dipole antenna, according to another embodiment of the invention.

FIG. 3D illustrates a top view 330 of the symmetrical transitional structure coupling the strip line 104 to a non-planar dipole antenna 333, according to another embodiment of the invention. In one embodiment, there are two signal layers between the ground planes 201 and 202. In such an embodiment, the strip line feed 104 resides in one signal layer. In one embodiment, the strip line 104 continues on the same layer beyond the truncated edge 108 of the ground planes 201 and 202 and flares and bends into the first arm 331 of the non-planar dipole antenna 333. In one embodiment, in the other signal layer, the ground currents are combined using vias 208*a* and 208*b* and the horse-shoe like structure 334 which connects to a metal strip 106*a* on the same layer which then flares and bends into the second arm 332 of the non-planar dipole antenna 333. In the above embodiment, the vias 208*a* and 208*b* and the horse-shoe like structure 334 form the transition with integrated balun 105.

Figure 4A:
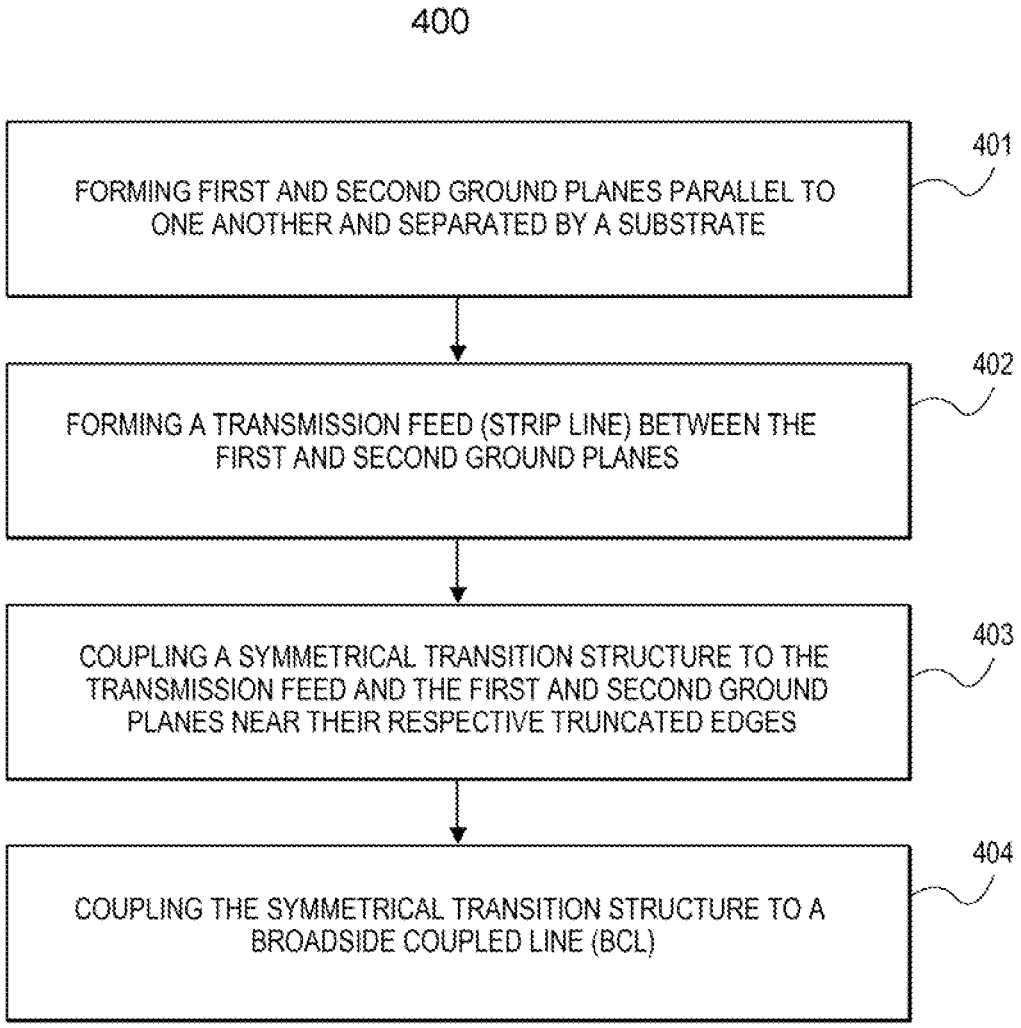
FIG. 4A illustrates a method 400 for forming the apparatus of FIGS. 1-3, according to one embodiment of the invention.

FIG. 4A illustrates a method 400 for forming the apparatus of FIGS. 1-3, according to one embodiment of the invention. The blocks of the method flow chart 400 may be performed in any order. At block 401, first and second ground planes 201 and 202 are formed parallel to one another such that they are separated by a dielectric substrate 311. At block 402, a transmission feed 104 is formed between the first and second ground planes, such that the transmission feed 104 is also parallel to the ground planes 201 and 202. At block 403, a symmetrical transition structure 105 is coupled to the transmission feed 104 and the first and second ground planes 201 and 202 near their respective truncated edges. At block 404, the symmetrical transition structure is electrically coupled to the BCL 106.

Figure 4B:
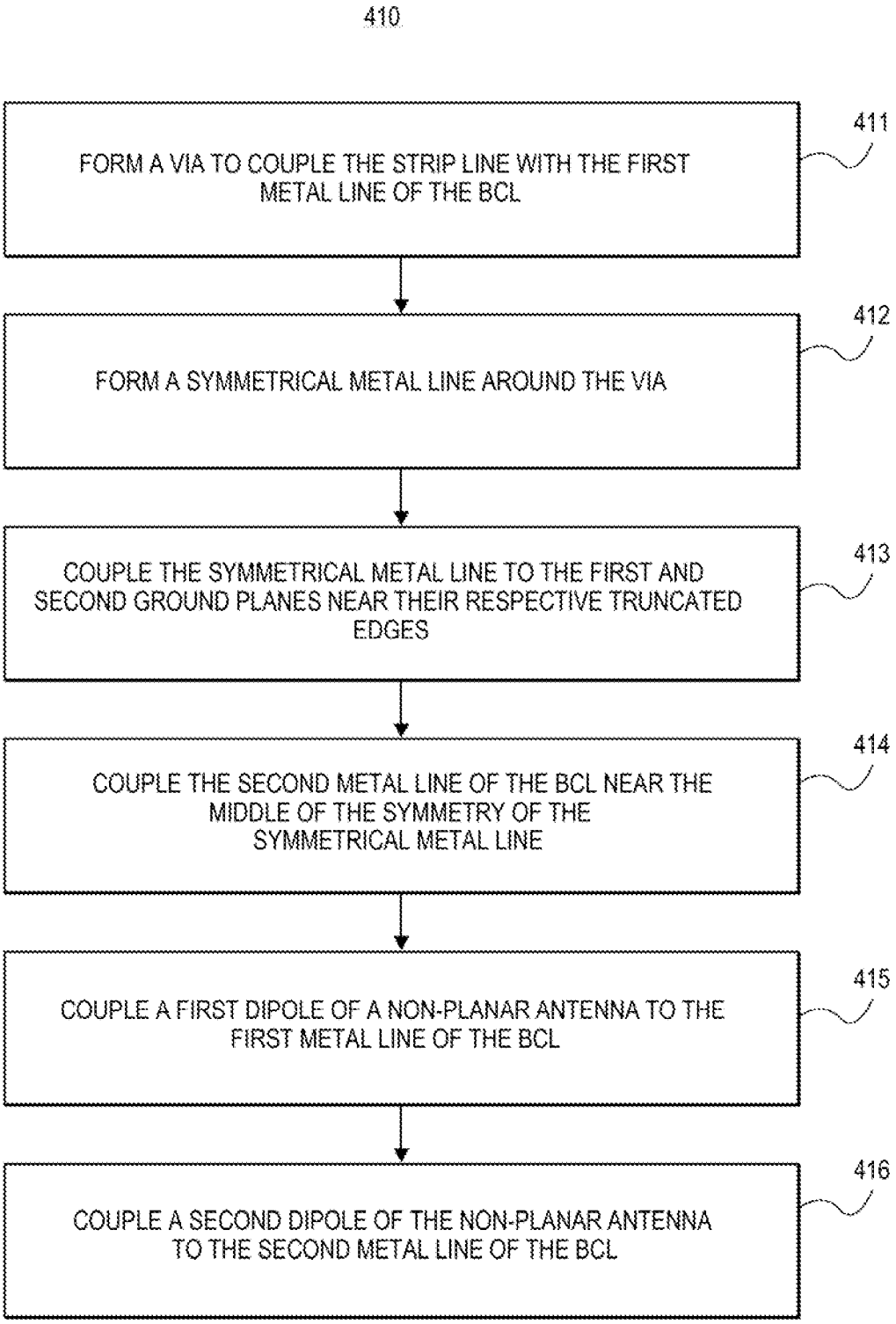
FIG. 4B illustrates a method flow chart for forming the symmetrical transitional structure for a multi-layer substrate, and for forming an end fire non-planar antenna, according to one embodiment of the invention.

FIG. 4B illustrates a method flow chart 410 for forming the symmetrical transitional structure 204/105 for a multi-layer substrate, and for forming an end fire non-planar antenna, according to one embodiment of the invention. The method is described with reference to FIGS. 1-3. In one embodiment, the blocks of the method flow chart can be performed in any order.

At block 411, via 209 is formed and filled or plated with metal, to couple the strip line 104 to the first metal line 106*a* of the BCL 106. At block 412, metal line 205 is formed symmetrically around the via 209 such that the prongs of the metal line 205 extend towards the truncated edges of the ground planes 201 and 202, while the common point where the two prongs of the metal line 205 originate is for coupling to the BCL 106. At block 413, the prongs of the symmetrical metal line 205 are coupled to the first and second ground planes 201 and 202 by use of the vias 208*a* and 208*b*, which are filled or plated with metal. At block 414, the second metal line 106*b* of the BCL 106 is coupled near the middle of the symmetry (the common point 206) of the symmetrical metal line 205.

At block 415, the first dipole arm 301 is orthogonally coupled to the first metal line 106*a* of the BCL 106. At block 416, the second dipole arm 302 is orthogonally coupled to the second metal line 106*b* of the BCL 106, wherein the first and second dipole arms 301 and 302 are in different planes, and wherein the first dipole arm 301 is in the same plane as the planes of the first strip line 106*a* while the second dipole arm 302 is in the same plane as the plane of the second strip line 106*b*.

Elements of embodiments are provided as a machine-readable medium for storing the computer-executable instructions. The computer readable/executable instructions codify the methods of FIGS. 4A-B. In one embodiment, the machine-readable medium may include, but is not limited to, flash memory, optical disks, CD-ROMs, DVD ROMs, RAMs, EPROMs, EEPROMs, magnetic or optical cards, or other type of machine-readable media suitable for storing electronic or computer-executable instructions. For example, embodiments of the invention may be downloaded as a computer program (e.g., BIOS) which may be transferred from a remote computer (e.g., a server) to a requesting computer (e.g., a client) by way of data signals via a communication link (e.g., a modem or network connection). In one embodiment, these computer-executable instructions when executed by a processor cause the processor to perform the method of FIGS. 4A-B.

Figure 5:
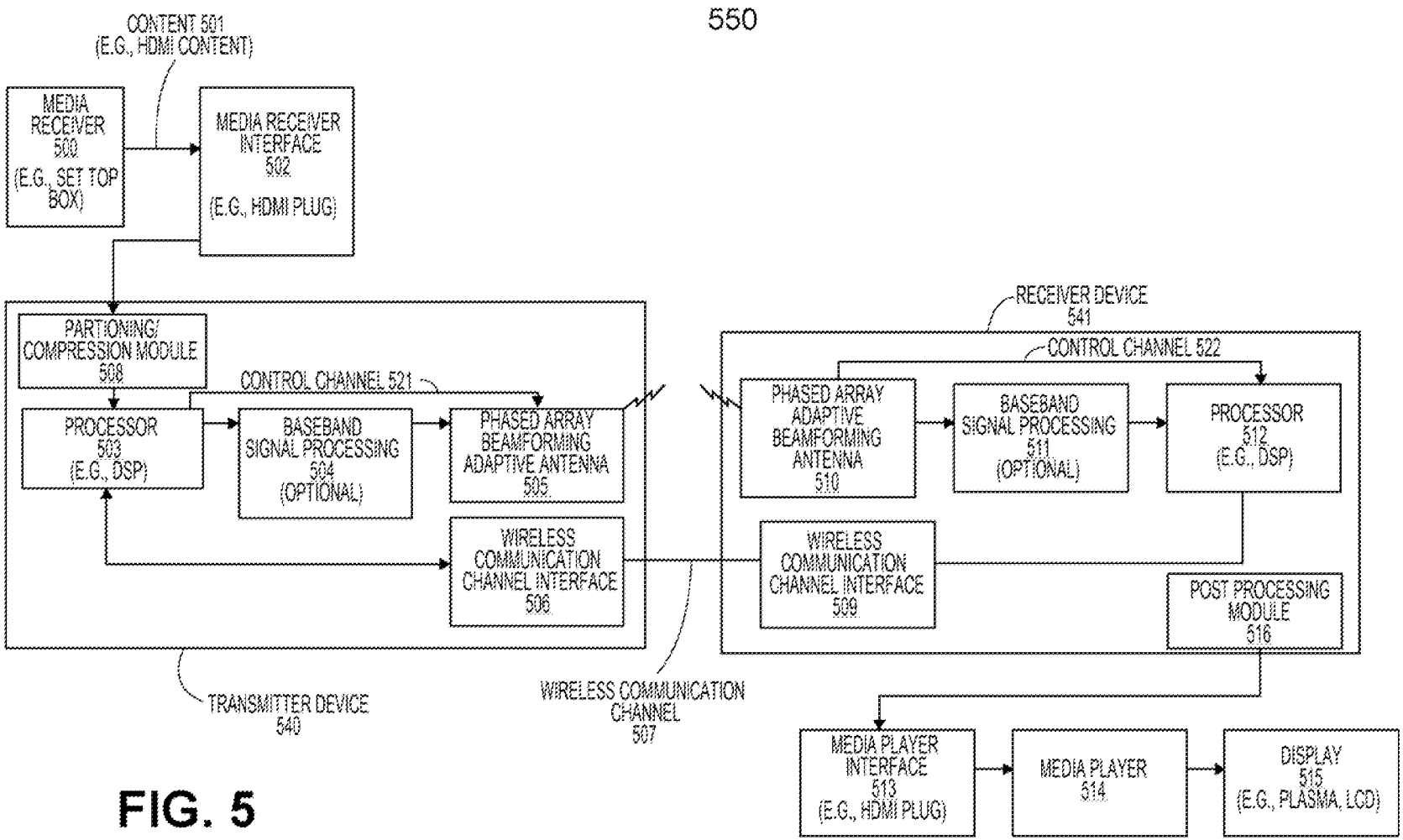
FIG. 5 is a block diagram of a communication system having the symmetrical transition structure, according to one embodiment of the invention.

FIG. 5 is a block diagram of a communication system 550 having the symmetrical transition structure 204/105, according to one embodiment of the invention. In one embodiment, the system 550 comprises media receiver 500, a media receiver interface 502, a transmitting device 540, a receiving device 541, a media player interface 513, a media player 514 and a display 515.

In one embodiment, the media receiver 500 receives content from a source (not shown). In one embodiment, the media receiver 500 comprises a set top box. The content may comprise baseband digital video, such as, for example, but not limited to, content adhering to the HDMI or DVI standards. In such a case, the media receiver 500 may include a transmitter (e.g., an HDMI transmitter) to forward the received content.

In one embodiment, the media receiver 500 sends content 501 to transmitter device 540 via media receiver interface 502. In one embodiment, the media receiver interface 502 includes logic that converts content 501 into HDMI content. In such a case, the media receiver interface 502 comprises an HDMI plug and content 501 is sent via a wired connection. In one embodiment, the transfer of the content 501 occurs through a wireless connection. In another embodiment, the content 501 comprises DVI content.

In one embodiment, the transmitter device 540 wirelessly transfers information to the receiver device 541 using two wireless connections. One of the wireless connections is through a phased array antenna 505 with adaptive beamforming. In one embodiment, the phase array antenna 505 comprises the compact transitional structure 204/105 which couples the strip line 104 to the non-planar end-fire dipole antenna (301 and 302) via the BCL 106.

In one embodiment, the transmitter device 540 comprises the first matching device 103. In one embodiment, the first matching device 103 is an RFIC. In one embodiment, the RFIC is part of the adaptive antenna 505. In one embodiment, the wireless communication channel interface 506 is also implemented within the RFIC. In one embodiment, the adaptive antenna comprises a plurality of strip lines which are coupled to the RFIC, wherein the plurality of strip lines are positioned between the first and second ground planes (201 and 202) which are parallel to one another, each of the first and second ground planes having respective truncated edges. In one embodiment, the adaptive antenna 505 further comprises a plurality of symmetrical transition structures, each (204/105) of which is coupled to a corresponding strip line (104) from the plurality of strip lines, and to the first and second ground planes (201 and 202) near their respective truncated edges, and further coupled to a plurality of BCLs (a plurality of 106 lines).

The other wireless connection is via wireless communications channel 507, referred to herein as the back channel. In one embodiment, wireless communications channel 507 is uni-directional. In an alternative embodiment, wireless communications channel 507 is bi-directional.

In one embodiment, the receiver device 541 transfers the content received from transmitter device 540 to media player 514 via media player interface 513. In one embodiment, the content received from the transmitter device 540 is converted into a standard content format by the post processing module 516. In one embodiment, the transfer of the content between receiver device 541 and media player interface 513 occurs through a wired connection. In one embodiment, the transfer of the content could occur through a wireless connection. In one embodiment, media player interface 513 comprises an HDMI plug. In one embodiment, the transfer of the content between the media player interface 513 and the media player 514 occurs through a wired connection. In one embodiment, the transfer of content occurs through a wireless connection.

In one embodiment, the media player 514 causes the content to be played on a display 515. In one embodiment, the content is HDMI content and the media player 514 transfer the media content to display via a wired connection. In one embodiment, the transfer occurs through a wireless connection. In one embodiment, the display 515 comprises a plasma display, an LCD, a CRT, etc.

In one embodiment, the system 550 is altered to include a DVD player/recorder in place of a DVD player/recorder to receive, and play and/or record the content.

In one embodiment, transmitter 540 and media receiver interface 502 are part of media receiver 500. Similarly, in one embodiment, receiver 541, media player interface 513, and media player 514 are all part of the same device. In an alternative embodiment, receiver 541, media player interface 513, media player 514, and display 515 are all part of the display.

In one embodiment, transmitter device 540 comprises a processor 503, an optional baseband processing component 504, a phased array antenna 505, and a wireless communication channel interface 506. In one embodiment, the transmitter device further comprises a compression module 508 to receive media content and provide it to the processor 503. Phased array antenna 505 comprises a radio frequency (RF) transmitter having a digitally controlled phased array antenna coupled to and controlled by processor 503 to transmit content to receiver device 541 using adaptive beamforming.

In one embodiment, the phase array antenna 505 comprises a plurality of strip lines are coupled to an RFIC, wherein the plurality of strip lines are positioned between the first and second ground planes (201 and 202) which are parallel to one another, each of the first and second ground planes having respective truncated edges. In one embodiment, the adaptive antenna 505 further comprises a plurality of symmetrical transition structures, each (204/105) of which is coupled to a corresponding strip line (104) from the plurality of strip lines, and to the first and second ground planes (201 and 202) near their respective truncated edges, and further coupled to a plurality of BCLs (a plurality of 106 lines).

In one embodiment, receiver device 541 comprises a processor 512, an optional baseband processing component 511, a phased array antenna 510, and a wireless communication channel interface 509. Phased array antenna 510 comprises a radio frequency (RF) transmitter having a digitally controlled phased array antenna coupled to and controlled by processor 512 to receive content from transmitter device 540 using adaptive beam forming.

In one embodiment, the phase array antenna 510 comprises a plurality of strip lines 104 coupled to an RFIC, wherein the plurality of strip lines 104 are positioned between the first and second ground planes (201 and 202) which are parallel to one another, each of the first and second ground planes (201 and 202) having respective truncated edges 108. In one embodiment, the adaptive antenna 505 further comprises a plurality of symmetrical transition structures, each (204/105) of the symmetrical transition structure is coupled to a corresponding strip line (104) from the plurality of strip lines 104 and to the first and second ground planes (201 and 202) near their respective truncated edges 108, and further coupled to a plurality of BCLs (a plurality of 106 lines).

In one embodiment, processor 503 generates baseband signals that are processed by baseband signal processing 504 prior to being wirelessly transmitted by phased array antenna 505. In such an embodiment, the receiver device 541 includes baseband signal processing to convert analog signals received by phased array antenna 510 into baseband signals for processing by processor 512. In one embodiment, the baseband signals are orthogonal frequency division multiplex (OFDM) signals.

In one embodiment, transmitter device 540 and/or receiver device 541 are part of separate transceivers.

In one embodiment, the transmitter device 540 and receiver device 541 perform wireless communication using phased array antenna with adaptive beamforming that allows beam steering. In one embodiment, processor 503 sends digital control information to phased array antenna 505 to indicate an amount to shift one or more phase shifters in phased array antenna 505 to steer a beam formed thereby in a manner well-known in the art. Processor 512 uses digital control information as well to control phased array antenna 510. The digital control information is sent using control channel 521 in transmitter device 540 and control channel 522 in receiver device 541. In one embodiment, the digital control information comprises a set of coefficients. In one embodiment, each of processors 503 and 512 comprises a digital signal processor.

In one embodiment, wireless communication link interface 506 is coupled to processor 503 and provides an interface between wireless communication link 507 and processor 503 to communicate antenna information relating to the use of the phased array antenna and to communicate information to facilitate playing the content at another location. In one embodiment, the information transferred between transmitter device 540 and receiver device 541 to facilitate playing the content includes encryption keys sent from processor 503 to processor 512 of receiver device 541 and one or more acknowledgments from processor 512 of receiver device 541 to processor 503 of transmitter device 540.

In one embodiment, wireless communication link (channel) 507 also transfers antenna information between transmitter device 540 and receiver device 541. During initialization of the phased array antennas 505 and 510, wireless communication link 507 transfers information to enable processor 503 to select a direction for the phased array antenna 505. In one embodiment, the information includes, but is not limited to, antenna location information and performance information corresponding to the antenna location, such as one or more pairs of data that include the position of phased array antenna 510 and the signal strength of the channel for that antenna position. In another embodiment, the information includes, but is not limited to, information sent by processor 512 to processor 503 to enable processor 503 to determine which portions of phased array antenna 505 to use to transfer content.

In one embodiment, when the phased array antennas 505 and 510 are operating in a mode during which they may transfer content (e.g., HDMI content), wireless communication link 507 transfers an indication of the status of communication path from the processor 512 of receiver device 541. The indication of the status of communication comprises an indication from processor 512 that prompts processor 503 to steer the beam in another direction (e.g., to another channel). Such prompting may occur in response to interference with transmission of portions of the content. The information may specify one or more alternative channels that processor 503 may use.

In one embodiment, the antenna information comprises information sent by processor 512 to specify a location to which receiver device 541 is to direct phased array antenna 510. This may be useful during initialization when transmitter device 540 is telling receiver device 541 where to position its antenna so that signal quality measurements can be made to identify the best channels. The position specified may be an exact location or may be a relative location such as, for example, the next location in a predetermined location order being followed by transmitter device 540 and receiver device 541.

In one embodiment, wireless communications link 507 transfers information from receiver device 541 to transmitter device 540 specifying antenna characteristics of phased array antenna 510, or vice versa.

Figure 6:
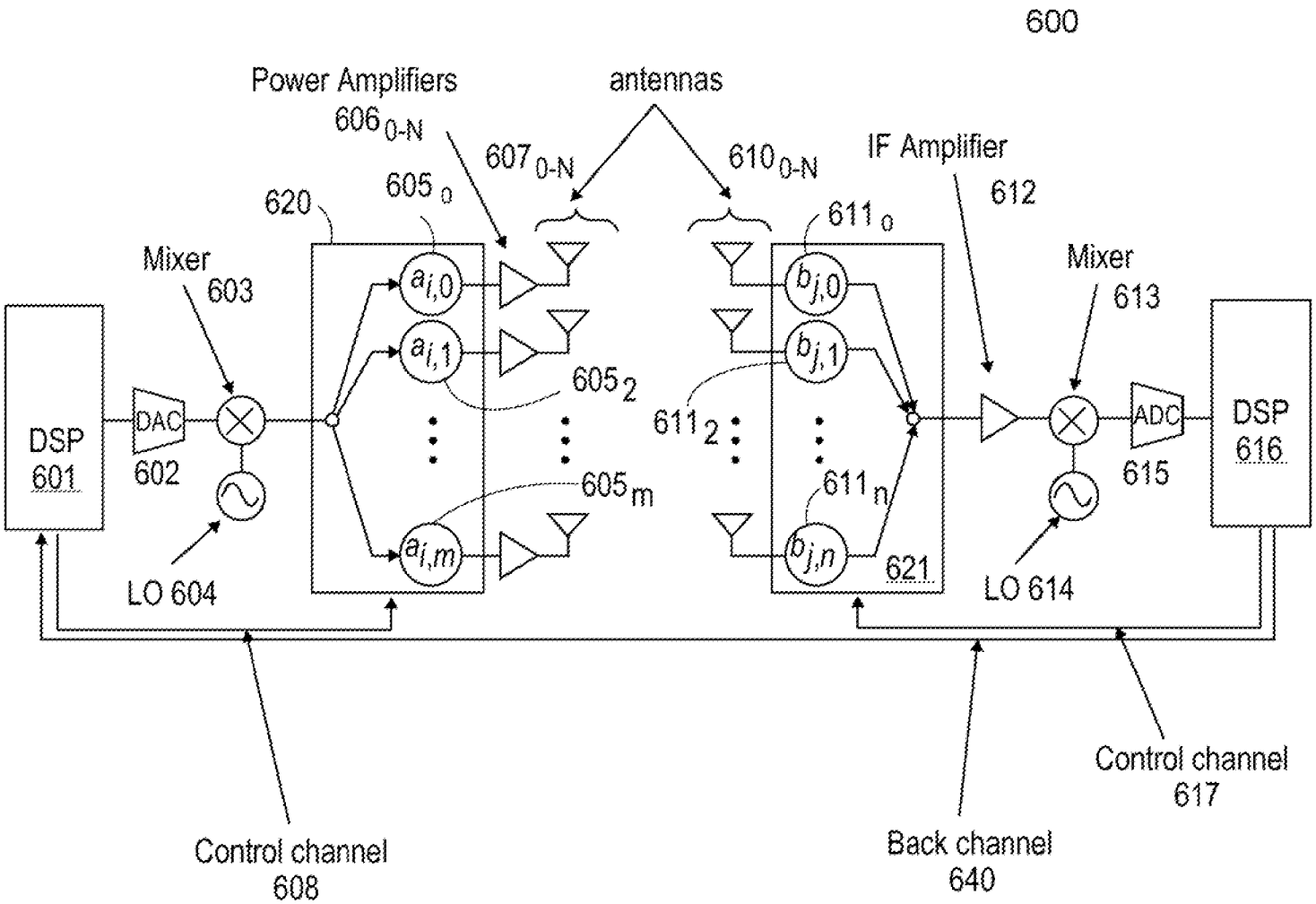
FIG. 6 is a block diagram of an adaptive beam forming a multiple antenna radio system containing a transmitter device and a receiver device of FIG. 5, according to one embodiment of the invention.

FIG. 6 is a block diagram of one embodiment of an adaptive beam forming multiple antenna radio system 600 containing transmitter device 540 and receiver device 541 of FIG. 5. In one embodiment, the transceiver 600 includes multiple independent transmit and receive chains. In one embodiment, the transceiver 600 performs phased array beam forming using a phased array that takes an identical RF signal and shifts the phase for one or more antenna elements in the array to achieve beam steering.

In one embodiment, the Digital Signal Processor (DSP) 601 formats the content and generates real time baseband signals. In one embodiment, the DSP 601 may provide modulation, FEC coding, packet assembly, interleaving and automatic gain control.

In one embodiment, the DSP 601 then forwards the baseband signals to be modulated and sent out on the RF portion of the transmitter. In one embodiment, the content is modulated into OFDM signals in a manner well known in the art.

In one embodiment, Digital-to-analog converter (DAC) 602 receives the digital signals output from DSP 601 and converts them to analog signals. In one embodiment, the signals output from DAC 602 are between 0-256 MHz signals.

In one embodiment, mixer 603 receives signals output from DAC 602 and combines them with a signal from a local oscillator (LO) 604. In one embodiment, the signals output from mixer 603 are at an intermediate frequency. In one embodiment, the intermediate frequency is between 2-9 GHz.

In one embodiment, multiple phase shifters $605_{0\text{-}M}$ receive the output from mixer 603. In one embodiment, a demultiplier is included to control which phase shifters receive the signals. In one embodiment, these phase shifters are quantized phase shifters. In an alternative embodiment, the phase shifters may be replaced by complex multipliers. In one embodiment, DSP 601 also controls, via control channel 608, the phase and magnitude of the currents in each of the antenna elements in phased array antenna 620 to produce a desired beam pattern in a manner well-known in the art. In other words, DSP 601 controls the phase shifters $605_{0\text{-}M}$ of phased array antenna 620 to produce the desired pattern.

In one embodiment, each of phase shifters $605_{0\text{-}M}$ produces an output that is sent to one of power amplifiers $606_{0\text{-}M}$, which amplify the signal. In one embodiment, the amplified signals are sent to antenna array 607 which has multiple antenna elements $607_{0\text{-}N}$. In one embodiment, the signals transmitted from antennas $607_{0\text{-}N}$ are radio frequency signals between 56-64 GHz. Thus, multiple beams are output from phased array antenna 620.

In one embodiment, the antennas $607_{0\text{-}N}$ comprise transmission feed 104, transition structure 105, a BCL 106, and non-planar antennas 107 as discussed with reference to FIGS. 1-4. In one embodiment, the antennas also include planar antennas along with non-planar antennas of FIGS. 1-4.

With respect to the receiver, antennas $610_{0\text{-}N}$ receive the wireless transmissions from antennas $607_{0\text{-}N}$ and provide them to phase shifters $611_{0\text{-}N}$. As discussed above, in one embodiment, phase shifters $611_{0\text{-}N}$ comprise quantitized phase shifters. Alternatively, in one embodiment, phase shifters $611_{0\text{-}N}$ may be replaced by complex multipliers. In one embodiment, phase shifters $611_{0\text{-}N}$ receive the signals from antennas $610_{0\text{-}N}$, which are combined to form a single line feed output. In one embodiment, a multiplexer is used to combine the signals from the different elements and output the single feed line. In one embodiment, the output of phase shifters $611_{0\text{-}N}$ is input to intermediate frequency (IF) amplifier 612, which reduces the frequency of the signal to an intermediate frequency. In one embodiment, the intermediate frequency is between 2-9 GHz.

In one embodiment, mixer 613 receives the output of the IF amplifier 612 and combines it with a signal from LO 614 in a manner well-known in the art. In one embodiment, the output of mixer 613 is a signal in the range of 0-250 MHz. In one embodiment, there are I and Q signals for each channel.

In one embodiment, Analog-to-digital converter (ADC) 615 receives the output of mixer 613 and converts it to digital form. In one embodiment, the digital output from ADC 615 is received by DSP 616. DSP 616 restores the amplitude and phase of the signal. DSPs 601 and 616 may provide demodulation, packet disassembly, de-interleaving and automatic gain control.

In one embodiment, each of the transceivers includes a controlling microprocessor that sets up control information for DSP. In one embodiment, the controlling microprocessor is on the same die as the DSP.

In one embodiment, the DSPs implement an adaptive algorithm with the beam forming weights being implemented in hardware. That is, the transmitter and receiver work together to perform the beam forming in RF frequency using digitally controlled analog phase shifters. In an alternative embodiment, the beamforming is performed in IF. In one embodiment, phase shifters $605_{0\text{-}M}$ and $611_{0\text{-}N}$ are controlled via control channel 608 and control channel 617, respectfully, via their respective DSPs in a manner well known in the art. For example, DSP 601 controls phase shifters $605_{0\text{-}M}$ to have the transmitter perform adaptive beam forming to steer the beam while DSP 601 controls phase shifters $\mathbf{611}_{0\text{-}N}$ to direct antenna elements to receive the wireless transmission from antenna elements and combine the signals from different elements to form a single line feed output. In one embodiment, a multiplexer is used to combine the signals from the different elements and output the single feed line.

In one embodiment, the DSP 601 performs the beam steering by pulsing, or energizing, the appropriate phase shifter connected to each antenna element. The pulsing algorithm under DSP 601 controls the phase and gain of each element.

In one embodiment, the adaptive beam forming antenna is used to avoid interfering obstructions. By adapting the beam forming and steering the beam, the communication can occur avoiding obstructions which may prevent or interfere with the wireless transmissions between the transmitter and the receiver.

In one embodiment, there are three phases of operations with respect to the adaptive beamforming antennas. In one embodiment, the three phases of operations are the training phase, a searching phase, and a tracking phase. In one embodiment, the training phase and searching phase occur during initialization. The training phase determines the channel profile with predetermined sequences of spatial patterns $\{A_{\hat{i}}\}$ and $\{B_{\hat{j}}\}$. In one embodiment, the searching phase computes a list of candidate spatial patterns $\{A_{\hat{i}}\}$, $\{B_{\hat{j}}\}$ and selects a prime candidate $\{A_{\hat{0}}, B_{\hat{0}}\}$ for use in the data transmission between the transmitter of one transceiver and the receiver of another. In one embodiment, the tracking phase keeps track of the strength of the candidate list. When the prime candidate is obstructed, the next pair of spatial patterns is selected for use.

In one embodiment, during the training phase, the transmitter sends out a sequence of spatial patterns $\{A_{\hat{i}}\}$. In such an embodiment, for each spatial pattern $\{A_{\hat{i}}\}$, the receiver projects the received signal onto another sequence of patterns $\{B_{\hat{j}}\}$. As a result of the projection, a channel profile is obtained over the pair $\{A_{\hat{i}}\}$, $\{B_{\hat{j}}\}$.

In one embodiment, an exhaustive training is performed between the transmitter and the receiver in which the antenna of the receiver is positioned at all locations and the transmitter sending multiple spatial patterns. In such an embodiment, M transmit spatial patterns are transmitted by the transmitter and N received spatial patterns are received by the receiver to form an N by M channel matrix. Thus, the transmitter goes through a pattern of transmit sectors and the receiver searches to find the strongest signal for that transmission. Then the transmitter moves to the next sector. At the end of the exhaustive search process, a ranking of all the positions of the transmitter and the receiver and the signals strengths of the channel at those positions has been obtained. In one embodiment, the information is maintained as pairs of positions of where the antennas are pointed and signal strengths of the channels. The list may be used to steer the antenna beam in case of interference.

In an alternative embodiment, bi-section training is used in which the space is divided in successively narrow sections with orthogonal antenna patterns being sent to obtain a channel profile.

Assuming DSP 601 is in a stable state, the direction the antenna should point is already determined. In the nominal state, the DSP will have a set of coefficients that it sends the phase shifters. The coefficients indicate the amount of phase the phase shifter is to shift the signal for its corresponding antennas. For example, DSP 601 sends a set digital control information to the phase shifters that indicate the different phase shifters are to shift different amounts, e.g., shift 30 degrees, shift 45 degrees, shift 90 degrees, shift 180 degrees, etc. Thus, the signal that goes to that antenna element will be shifted by a certain number of degrees of phase. The end result of shifting, for example, 16, 34, 32, 64 elements in the array by different amounts enables the antenna to be steered in a direction that provides the most sensitive reception location for the receiving antenna. That is, the composite set of shifts over the entire antenna array provides the ability to stir where the most sensitive point of the antenna is pointing over the hemisphere.

Note that in one embodiment the appropriate connection between the transmitter and the receiver may not be a direct path from the transmitter to the receiver. For example, the most appropriate path may be to bounce off the ceiling.

In one embodiment, the wireless communication system includes a back channel 640, or link, for transmitting information between wireless communication devices (e.g., a transmitter and receiver, a pair of transceivers, etc.). The information is related to the beamforming antennas and enables one or both of the wireless communication devices to adapt the array of antenna elements to better direct the antenna elements of a transmitter to the antenna elements of the receiving device together. The information also includes information to facilitate the use of the content being wirelessly transferred between the antenna elements of the transmitter and the receiver.

In FIG. 6, back channel 640 is coupled between DSP 616 and DSP 601 to enable DSP 616 to send tracking and control information to DSP 601. In one embodiment, back channel 640 functions as a high speed downlink and an acknowledgement channel.

In one embodiment, the back channel is also used to transfer information corresponding to the application for which the wireless communication is occurring (e.g., wireless video). Such information includes content protection information. For example, in one embodiment, the back channel is used to transfer encryption information (e.g., encryption keys and acknowledgements of encryption keys) when the transceivers are transferring HDMI data. In such an embodiment, the back channel is used for content protection communications.

In one embodiment, in HDMI, encryption is used to validate that the data sink is a permitted device (e.g., a permitted display). In one embodiment, there is a continuous stream of new encryption keys that is transferred while transferring the HDMI datastream to validate that the permitted device hasn't changed. Blocks of frames for the HD TV data are encrypted with different keys and then those keys have to be acknowledged back on back channel 640 in order to validate the player. Back channel 640 transfers the encryption keys in the forward direction to the receiver and acknowledgements of key receipts from the receiver in the return direction. Thus, encrypted information is sent in both directions.

The use of the back channel for content protection communications is beneficial because it avoids having to complete a lengthy retraining process when such communications are sent along with content. For example, if a key from a transmitter is sent alongside the content flowing across the primary link and that primary link breaks, it will force a lengthy retrain of 2-3 seconds for a typical HDMI/HDCP system. In one embodiment, this separate bi-directional link that has higher reliability than the primary directional link given its omni-directional orientation. By using this back channel for communication of the HDCP keys and the appropriate acknowledgement back from the receiving device, the time consuming retraining can be avoided even in the event of the most impactful obstruction.

In one embodiment, during the active period when the beamforming antennas are transferring content, the back channel is used to allow the receiver to notify the transmitter about the status of the channel. For example, while the channel between the beamforming antennas is of sufficient quality, the receiver sends information over the back channel to indicate that the channel is acceptable. In one embodiment, the back channel may also be used by the receiver to send the transmitter quantifiable information indicating the quality of the channel being used. If some form of interference (e.g., an obstruction) occurs that degrades the quality of the channel below an acceptable level or prevents transmissions completely between the beamforming antennas, the receiver can indicate that the channel is no longer acceptable and/or can request a change in the channel over the back channel. In one embodiment, the receiver may request a change to the next channel in a predetermined set of channels or may specify a specific channel for the transmitter to use.

In one embodiment, the back channel is bi-directional. In such a case, in one embodiment, the transmitter uses the back channel to send information to the receiver. Such information may include information that instructs the receiver to position its antenna elements at different fixed locations that the transmitter would scan during initialization. The transmitter may specify this by specifically designating the location or by indicating that the receiver should proceed to the next location designated in a predetermined order or list through which both the transmitter and receiver are proceeding.

In one embodiment, the back channel is used by either or both of the transmitter and the receiver to notify the other of specific antenna characterization information. For example, the antenna characterization information may specify that the antenna is capable of a resolution down to 6 degrees of radius and that the antenna has a certain number of elements (e.g., 32 elements, 64 elements, etc.).

In one embodiment, communication on the back channel is performed wirelessly by using interface units. Any form of wireless communication may be used. In one embodiment, OFDM is used to transfer information over the back channel. In another embodiment, CPM is used to transfer information over the back channel.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may," "might," or "could" be included, that particular component, feature, structure, or characteristic is not required to be included. If the specification or claim refers to "a" or "an" element, that does not mean there is only one of the elements. If the specification or claims refer to "an additional" element, that does not preclude there being more than one of the additional element.

While the invention has been described in conjunction with specific embodiments thereof, many alternatives, modifications and variations of such embodiments will be apparent to those of ordinary skill in the art in light of the foregoing description. The embodiments of the invention are intended to embrace all such alternatives, modifications, and variations as to fall within the broad scope of the appended claims.

I claim:

1. An apparatus comprising:

first and second ground planes each of which having respective truncated edges, the first and second ground planes being parallel to one another and separated by a multi-layer substrate;

a strip line positioned between the first and second ground planes; and a symmetrical transition structure, coupled to the strip line and the first and second ground planes near their respective truncated edges, and further coupled to a broadside coupled line (BCL), wherein the symmetrical transition structure comprises a first transitional metal line symmetrical to an axis of symmetry along the strip line, and the symmetrical transition structure couples to the BCL near a middle of symmetry of the first transitional metal line.

2. The apparatus of claim 1, wherein the BCL comprises first and second metal lines which are on different planes.

3. The apparatus of claim 2, wherein the strip line is on a plane which is the same plane as the plane of the second metal line of the BCL.

4. The apparatus of claim 2, wherein:

the first transitional metal line is symmetrical around a via, filled or plated with metal, and the first transitional metal line is coupled to the first and second ground planes near their respective truncated edges, and further coupled to the second metal line of the BCL, wherein the via couples the strip line to the first metal line of the BCL.

5. The apparatus of claim 4, wherein the symmetrical transition structure comprises:

a second transitional metal line symmetrical around the via and the first transitional metal line, the second transitional metal line coupled to the first and second ground planes near their respective truncated edges and further coupled to the second metal line of the BCL.

6. The apparatus of claim 4, wherein the second metal line of the BCL is coupled to the first transitional metal line of the symmetrical transition structure near the middle of the symmetry of the first transitional metal line.

7. The apparatus of claim 4, wherein the first transitional metal line of the symmetrical transition structure is coupled to the first and second ground planes by use of vias, filled or plated with metal, which electrically short the first and second ground planes.

8. The apparatus of claim 2 further comprises:

a first matching device coupled to the strip line; and a second matching device coupled to the symmetrical transition structure via the BCL.

9. The apparatus of claim 8, wherein the first matching device comprises a radio frequency integrated circuit.

10. The apparatus of claim 8, wherein the second matching structure includes a non-planar dipole antenna.

11. The apparatus of claim 10, wherein the non-planar dipole antenna is an end-fire antenna comprising:

a first dipole arm coupled to the first metal line of the BCL, and orthogonal to the first metal line of the BCL; and a second dipole arm coupled to the second metal line of the BCL, and orthogonal to the second metal line of the BCL.

12. A system comprising:

a radio frequency integrated circuit (RFIC);

a plurality of strip lines coupled to the RFIC, the plurality of strip lines positioned between first and second ground planes which are parallel to one another, each of the first and second ground planes having respective truncated edges; and a plurality of symmetrical transition structures, each of which is coupled to a corresponding strip line from the plurality of strip lines, and to the first and second ground planes near their respective truncated edges, and further coupled to a plurality of broadside coupled lines (BCLs), wherein each of the symmetrical transition structures comprises a symmetrical metal line symmetrical to an axis of symmetry along the corresponding strip line, and wherein each of the symmetrical transition structures couples to a corresponding BCL from the plurality of BCLs near a middle of symmetry of its respective symmetrical metal line.

13. The system of claim 12, wherein each BCL of the plurality of BCLs comprises first and second metal lines which are on different planes.

14. The system of claim 13, wherein the first and second metal lines of the corresponding BCL are on different planes, and wherein the second metal line of the corresponding BCL is on the same plane as the corresponding strip line.

15. The system of claim 13, wherein the plurality of strip lines is on a plane which is the same plane as the plane of the second metal line.

16. The system of claim 13 further comprises:

a plurality of matching devices, each coupled to a corresponding symmetrical transition structure via a corresponding BCL.

17. The system of claim 16, wherein the plurality of matching devices includes a non-planar dipole antenna.

18. The system of claim 17, wherein the non-planar dipole antenna is an end-fire antenna comprising:

a first dipole arm coupled to the first metal line of the BCL, and orthogonal to the first metal line of the BCL; and a second dipole arm coupled to the second metal line of the BCL, and orthogonal to the second metal line of the BCL.

19. The system of claim 13, wherein each of the symmetrical metal lines is symmetrical around a corresponding via, filled or plated with metal, and each of the symmetrical metal lines is coupled to the first and second ground planes near their respective truncated edges, and further coupled to the second metal line of the corresponding BCL, wherein the via couples the corresponding strip line, from the plurality of strip lines, to the first metal line of the corresponding BCL.

20. The system of claim 19, wherein the second metal line of the corresponding BCL is coupled to the symmetrical metal line of a corresponding symmetrical transition structure of the plurality of symmetrical transition structures, near the middle of the symmetry of the symmetrical metal line.

21. The system of claim 19, wherein the symmetrical metal line of a corresponding symmetrical transition structure is coupled to the first and second ground planes by use of vias, filled or plated with metal, which electrically short the first and second ground planes.

22. A method comprising:

forming first and second ground planes, each having their respective truncated edges, the first and second ground planes being parallel to one another and separated by a multi-layer substrate;

forming a strip line between the first and second ground planes; and coupling a symmetrical transition structure to the strip line and the first and second ground planes near their respective truncated edges, and further coupling the symmetrical transition structure to a broadside coupled line (BCL), wherein the symmetrical transition structure comprises a symmetrical metal line symmetrical to an axis of symmetry along the strip line, and the symmetrical transition structure couples to the BCL near a middle of symmetry of the symmetrical metal line.

23. The method of claim 22, wherein the BCL comprises first and second metal lines which are on different planes.

24. The method of claim 23 further comprises:

coupling a first matching device to the strip line; and coupling a second matching device to the symmetrical transition structure via the BCL.

25. The method of claim 24, wherein the second matching device includes a non-planar dipole antenna having first and second dipole arms, wherein the method further comprises:

coupling the first dipole arm to the first metal line of the BCL, wherein the first dipole arm is orthogonal to the first metal line; and coupling the second dipole arm to the second metal line of the BCL, wherein the second dipole arm is orthogonal to the second metal line.

26. The method of claim 23, wherein coupling the symmetrical transition structure to the strip line comprises:

forming a via to couple the strip line to the first metal line of the BCL;

forming the symmetrical metal line around the via;

coupling the symmetrical metal line to the first and second ground planes near their respective truncated edges; and coupling the second metal line of the BCL near the middle of the symmetry of the symmetrical metal line.

27. The method of claim 26, wherein coupling the symmetrical metal line to the first and second ground planes near their respective truncated edges comprises:

shorting the first and second ground planes near their respective truncated edges by vias filled or plated with metal.

28. The method of claim 26, wherein forming the strip line between the first and second ground planes comprises forming the strip line on a plane which is the same plane as the plane of the second metal line of the BCL.

* * * * *